US007861446B2

(12) United States Patent
Walton

(10) Patent No.: US 7,861,446 B2
(45) Date of Patent: Jan. 4, 2011

(54) SIGNCASE SYSTEM AND METHOD FOR MANUFACTURING SAME

(76) Inventor: Charles M. Walton, 4771 Country Meadows Blvd., Sarasota, FL (US) 34235

( * ) Notice: Subject to any disclaimer, the term of this patent is extended or adjusted under 35 U.S.C. 154(b) by 288 days.

(21) Appl. No.: 12/315,133

(22) Filed: Nov. 28, 2008

(65) Prior Publication Data

US 2009/0145011 A1 Jun. 11, 2009

Related U.S. Application Data

(60) Provisional application No. 60/990,463, filed on Nov. 27, 2007.

(51) Int. Cl.
*G09F 13/00* (2006.01)

(52) U.S. Cl. ..... 40/549; 40/564; 248/220.1

(58) Field of Classification Search ..... 40/549, 40/574, 564; 248/200, 220.1
See application file for complete search history.

(56) References Cited

U.S. PATENT DOCUMENTS

| | | | | | |
|---|---|---|---|---|---|
| 2,626,473 | A * | 1/1953 | Howenstine | ..... | 40/574 |
| 3,391,481 | A * | 7/1968 | Lloyd | ..... | 40/549 |
| 3,593,447 | A * | 7/1971 | Winegarten | ..... | 40/564 |
| 3,835,613 | A * | 9/1974 | Davies, Jr. | ..... | 52/656.1 |
| 3,863,372 | A * | 2/1975 | Stilling | ..... | 40/574 |
| 4,217,714 | A * | 8/1980 | Ramsay | ..... | 40/549 |
| 4,265,039 | A * | 5/1981 | Brooks | ..... | 40/603 |
| 4,267,657 | A * | 5/1981 | Kloke | ..... | 40/549 |
| 5,042,182 | A * | 8/1991 | King | ..... | 40/603 |

* cited by examiner

*Primary Examiner*—Gary C Hoge
(74) *Attorney, Agent, or Firm*—Robert S. Pippenger; Shumaker, Loop & Kendrick, LLP

(57) ABSTRACT

The present invention comprises a simple, inventive sign bracket for use in the creation of signs of surprising structural integrity in a range of dimensions, said bracket characterized by a profile comprising a sign body, a C-bracket, and optionally an interlocking sign hanger and/or an angle retainer.

17 Claims, 6 Drawing Sheets

SIGNCASE SYSTEM AND METHOD FOR MANUFACTURING SAME

This application claims priority to U.S. Provisional application No. 60/990,463, filed on Nov. 27, 2007, which is herein incorporated by reference.

BACKGROUND OF THE INVENTION

A business can increase its visibility by having a prominent sign. While a simple sign may suffice to inform the consumer of the presence of the business, it often takes more to bring the consumer inside. A sign which is attractive and customized to the goods or services sold by the store can be more persuasive to prospective customers than a sign which is partially or completely fabricated from components which are obviously stock. Customized signs generally indicate to consumers that the proprietor has put a great deal of care into the business, and a consumer is likely to be pleased with the out come of transactions with the proprietor. Thus there is a demand for custom signs, particularly lighted custom signs, of all dimensions and types, from ground mounted "monument" style signs and hanging signs, which are intended to be viewed from two directions, to wall-mounted signs having one viewing face; from less conspicuous, small lit signs, such as a foot square hotel vacancy sign, to signs several stories high with similar width.

However, most sign construction methods for construction of signs having interior space, serving to contain, for example, lighting means, are unable to be used for the construction of such a range of sign dimensions without changes in design to accommodate large dimensions. For example, one of the factors for keeping down the costs of sign construction is the common availability of the construction components. Thus, the low cost fabrication of a wide variety of sign dimensions is served when the sign components are easily fabricated and usable with little or no customization. For example, component fabrication by extrusion is currently a convenient method for the fabrication of "rail"-type components (a component having essentially a constant profile throughout its length) at minimal production cost. Such components include the long brackets which extend along the edges of the sign, anchoring the sign front and rear faces to the adjacent side pieces ("sign body" pieces). However, not all profile types are easily produced by extrusion, and thus, in some situations, a part is custom must be fabricated according to the specifics of the sign, or even produced through customization of extruded parts. For example, customization needs which could prohibitively raise the cost of sign construction are the need to increase metal thickness or gauge with sign dimension.

Another factor which could raise cost as dimensions change is the need to change the cross sections of the basic structural beam materials in order to meet stability requirements for larger or smaller signs. Such a change is a problem because cost is minimized by designs using pieces which can be easily made by extrusion processes. Many sign construction designs presently on the market rely on extruded pieces which require either extensive cross bracing as sign dimensions increase, or they require the replacement of extruded components with other components having a different profile (for example, increased gauge) such that the design can be used for larger sign dimensions. A design which requires a change in the profile of the extruded components means that sign building companies must have pieces of different cross sections on easily available for signs of different dimensions, adding to the overall cost to build a sign according to the design. It should be noted that custom signs can be costly even before such a price increase in that they generally require the cutting of precisely sized construction elements such as side beams, sign bodies, cross members, and the like.

Current designs also have structural weaknesses as a consequence of aesthetic constraints. In several popular custom sign designs, the sign body is attached to the angle brackets by screws, which are visible on the surface of the sign body. Not only are the screws a target for vandals, they lend an "unfinished" appearance to the sign. However, when constructed using current designs, fastening methods which are less conspicuous/vulnerable to vandals, such as spot welding from the unexposed side, will still leave welding dimples on the exposed side.

A method and design for the construction of custom signs, providing signs of superior aesthetics, as well as excellent strength and stability, across a wide variety of dimensions without necessitating a change in gauge with increasing dimension would be welcome in the art. Such a method having reliance on parts which are easily prepared with present extrusion methods would be even more welcome in the art.

BRIEF DESCRIPTION OF THE INVENTION

Figure 1:
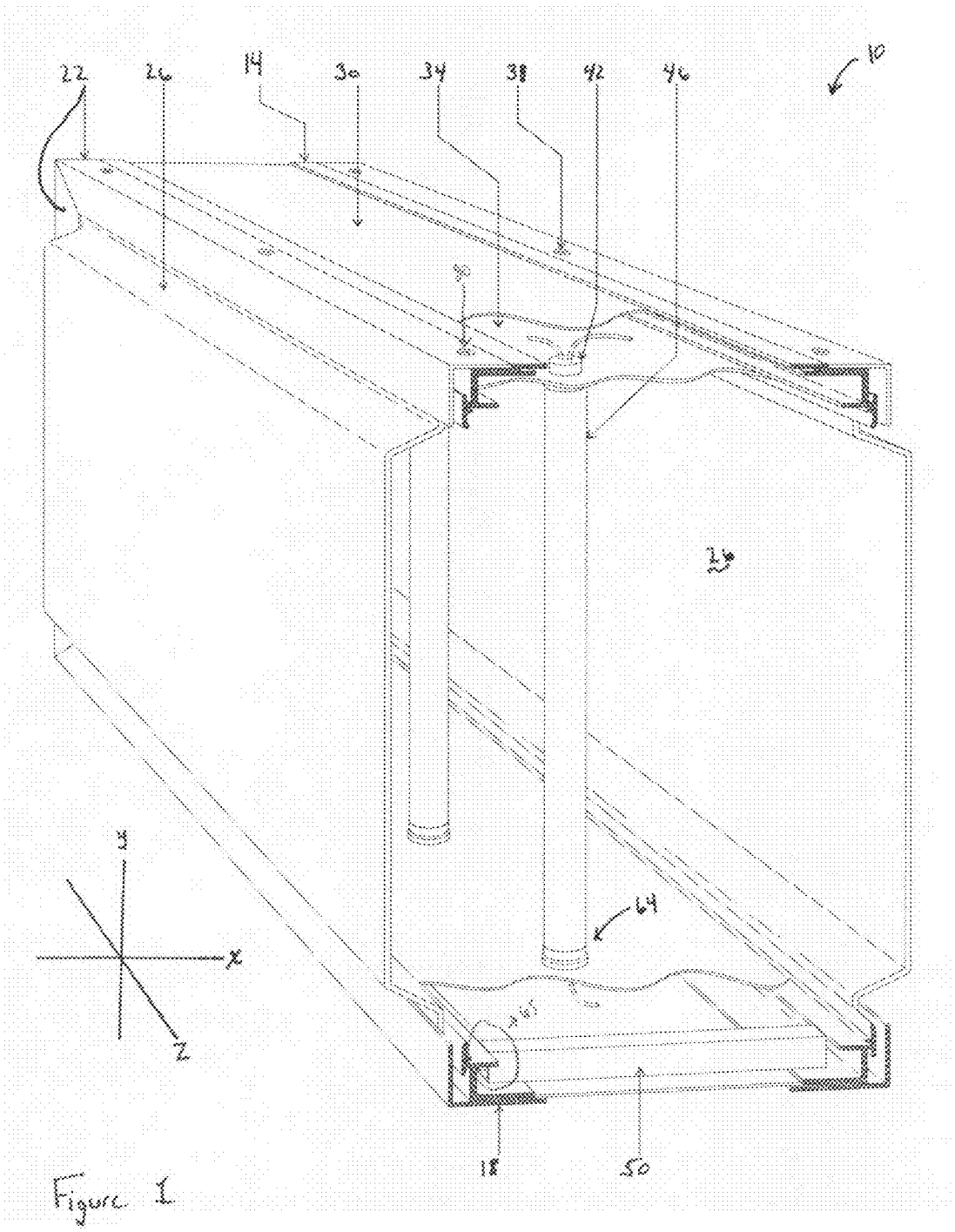
FIG. 1 is a cross-sectional perspective side view of one embodiment of the present invention.

The structural bracket of the present invention is characterized by a profile which comprises a sign body groove, a C-bracket, and optionally, an interlocking sign hanger. It should be clear from the disclosure that the sign body groove, C-bracket, and interlocking sign hanger refer to features of the profile of the inventive bracket. The bracket is generally lengthwise extending, having a profile (i.e., cross section perpendicular to longest axis of the component) which is essentially invariant along the length of the component. Thus, the individual components of the profile should be understood to extend in the direction perpendicular to the profile.

DETAILED DESCRIPTION OF THE DRAWINGS AND THE PREFERRED EMBODIMENTS

Furthermore, while the sign body groove, C-bracket, and optionally, interlocking sign hanger are referred to as components comprising the present invention, but it should be clear that no method of fabrication is implied by the resolution of the inventive bracket into these components for the purpose of clarity and ease of description; only that the inventive bracket as a whole must comprise the components. Thus, fabrication of the inventive sign bracket does not exclude the connection of pre-existing elements (body groove, a C-bracket, and optionally, an interlocking sign hanger) into the present invention. Alternatively, the inventive bracket can be formed in a method such that the fabricated bracket comprises the required elements. For example, it may be convenient and even preferable to fabricate the bracket by extrusion such that the bracket comprises the requisite elements. It may be convenient instead to form the bracket by, for example, the assembly of parts, which themselves may or may not be extruded. For example, while not preferred, the inventive bracket can be formed by bending and/or welding metal strips into the proper configuration. In one embodiment, an extruded strip is bent parallel to its long axis to form an "L" shape which comprises the long and central sides of the C-bracket, as well as the bottom of the sign groove. A strip having an appropriate profile is connected to the top of the long side of the C-bracket to form the sign body groove. A strip is connected at a 90 degree angle to the free end of the central side of the C-bracket, such that part of its length ("a free end") extends past the end of the central side in the direction opposite that of the long terminal side. A strip is connected to the free end in such a manner that a portion of its length extends to form the interlocking sign hanger.

In another embodiment, the C-bracket is prepared by bending or extruding, and the sign body groove is formed by the joining of another appropriately profiled strip to the upper surface of the long terminal end of the C-bracket. An interlocking sign hanger is attached to the central side of the C-bracket, and in one embodiment, the interlocking sign hanger is mounted low enough on the central side to form a continuation of the shorter terminal side of the C-bracket.

Thus, the elements of the inventive bracket can be assembled as such, or created in the formation or assembly of the bracket as a whole. In a most preferred embodiment, the bracket is extruded as a single piece which is characterized by a profile comprising a sign body groove, a C-bracket, and optionally, a sign hanger.

The discussion below generally refers to a cross section, or "profile" of the bracket because the bracket has essentially the same profile for its entire length (making extrusion a particularly convenient and thus preferred method of fabrication). While the discussion refers to parts of the profile being connected to other parts of the profile, this discussion should not be construed as limiting the method of fabrication (although it can be illustrative of a method of fabrication). The profile is a two dimensional rendering of the cross section, and thus the components of the profile are in a single plane.

The C-bracket (10) comprises three sides (FIG. 4): two terminal sides (15 and 20) and a central side (30). Generally, the terminal side comprising the sign body groove (40), is longer than the other terminal side (although in some embodiments, this is not so), and in the most preferred embodiment, the terminal sides connect to the central side at essentially 90 degree angles. Generally, the lengths of the terminal and central sides are independently in the range of from about 0.5 to 5 inches (although they can be shorter or longer, depending upon the requirements of the sign, such as, for example, sign dimension) and more preferably in the range of from about 0.5 to 2.5 inches; with the ratio of central side to longest terminal side in the range of from about 0.3 to about 3 (although, the ratio can be outside the foregoing range, for example, if dictated by the requirements, such as for example, dimension, of the sign).

In one embodiment, the terminal side comprising the lower lip of the sign body groove is longer than the remaining terminal side. In this embodiment, upon assembly, a portion of the longer terminal side is in contact with a surface of a cross brace, and the end of the remaining terminal side abuts a cross brace. In one embodiment, a portion of the lower surface of the longer side is in continuous contact with a surface of the cross brace, and in a further embodiment, the connection is secured by a securing means such as screws or welds.

In one embodiment, the terminal side comprising the lower lip (50) of the sign body groove is shorter than, or the same length as the remaining terminal side (20). In this embodiment, upon assembly, a portion of the longer terminal side is in contact with a surface of a cross brace and the end of the remaining terminal side abuts a cross brace. In different embodiments, a portion of the lower or upper surface of the longer side is in continuous contact with a surface of the cross brace, and in a further embodiment, the connection is secured by a securing means such as screws or welds. This embodiment is a method for achieving high strength by contacting the non-groove-bearing terminal side of the c-bracket with the cross brace.

The above embodiments achieve high strength by contacting the end of the shorter terminal side of the C-bracket with a cross brace, and in further embodiments, the contact is secured by a securing means such as a weld.

In a less preferred embodiment, both terminal sides are, for a portion of their lengths, in continuous or discontinuous contact with a surface of a cross brace, with, optionally, at least one of the contacts reinforced or secured by a reinforcing or securing means, such as welds, screws, rivets or the like.

As elucidated above, the C-bracket component can be fabricated separately and combined after its fabrication with one or more of the sign body groove and, optionally, the sign hanger; or the c-bracket can be intrinsically fabricated upon fabrication of the entire inventive bracket.

The sign body groove (40) is connected to one of the terminal sides of the C-bracket. It is preferred that the sign body groove have a profile such that the lower lip of the sign body groove (50) in effect be comprised by the associated terminal side (15) of the C-bracket, and the upper lip of the sign body groove (60) form an extension which extends parallel to the lower lip, preferably, but not necessarily overhanging the lower lip. In a preferred embodiment which is particularly suited to the additional use of an angled retainer (discussed infra) the upper lip is essentially the same thickness or gauge as the lower lip, and in another embodiment, it rises from the upper surface of the upper lip such that the angled retainer abuts it securely (70, FIG. 3). Preferably the rise is squared such that the squared end of the angled retainer is stopped. Such a measure serves to secure the angled retainer in place, and even though the angled retainer is generally additionally affixed by some method, such as screw or weld, preferably to the top surface of the upper terminal side of the C-bracket (80, FIG. 1). In this embodiment, upon assembly of the inventive bracket with a cross brace, the cross brace preferably contacts the underside of the lower lip of the sign body groove as well as the end of the lower side of the C-bracket (see 65, FIG. 1).

The inventive bracket further comprises an interlocking sign hanger (FIG. 4, 90) which is intended to interlock with a sign bearing an interlocking complementary hanging member. The sign hanger is generally connected to the C-bracket at the lower corner, where the central side and the lower terminal side meet (100) (although it may be connected at any position on the central side) and, in a preferred embodiment, comprises an extension of the lower terminal side. A hanging lip (110) extends upwardly, and preferably downwardly (120) from the foregoing extension. In one embodiment, the downward extension is contoured (140) to minimize crease damage to the sign. The interlocking sign hanger can further comprise a nub or nipple, which can be used to secure sign body (34, FIG. 1).

Another advantage of the design of bracket design of the present invention is the improved aesthetics achieved by the ability to secure the sign body by spot welding from the underside of the sign body groove. The overlap of the upper lip generally prevents any welding dimples in the visible surfaces of the sign body/sign body groove union. In prior designs, welding is often avoided for aesthetic reasons, and screws or rivets, which increase susceptibility to vandalism, were often used to secure the sign body. In a preferred embodiment, each lip independently has a length in the range of from about 0.1 to about 0.7 inches, with the upper lip overhanging the lower lip.

Furthermore, as a result of the stability and strength of the signs fabricated using the inventive bracket and design, the gauge of the metal comprising the brackets is less important than in prior designs, and the inventive bracket can comprise metal of thinner gauge than in prior designs. The preferred gauge of the metal comprising the C-bracket, the sign body groove and the sign hanger and angle bracket, if present, is preferably greater than 1/16 of an inch, and in preferred embodiments is 1/8, 3/16 or 1/4 inches. In other embodiments, straight sections of the bracket can independently have different gauges.

In another embodiment, the invention comprises an assembly comprising at least one inventive bracket at least one of which optionally comprises an angle retainer which may or may not be integral. In another embodiment, the bracket comprises an integral angle retainer, and the bracket is fabricated by extrusion.

The bracket of the present invention has excellent utility in the construction of "flex-face" type signs in that the interlocking sign hanger (2, FIG. 6) can be used to anchor suspenders (1). In one embodiment, the inventive bracket is joined in sections to produce a frame. In a preferred embodiment, the frame is closed, each side bearing one or more suspenders which function to maintain a sign within the frame.

The invention is described with reference to the drawings in which like elements are referred to by like numerals. The relationship and functioning of the various elements of this invention are better understood by the following detailed description. The invention is not limited to the embodiments illustrated in the drawings. It should also be understood that the drawings are not to scale. As used herein, referring to FIG. 1, width refers to portions of the system in the "Z" axis, depth refers to portions of the system in the "X" axis, and height refers to portions of the system in the "Y" axis.

Figure 2:
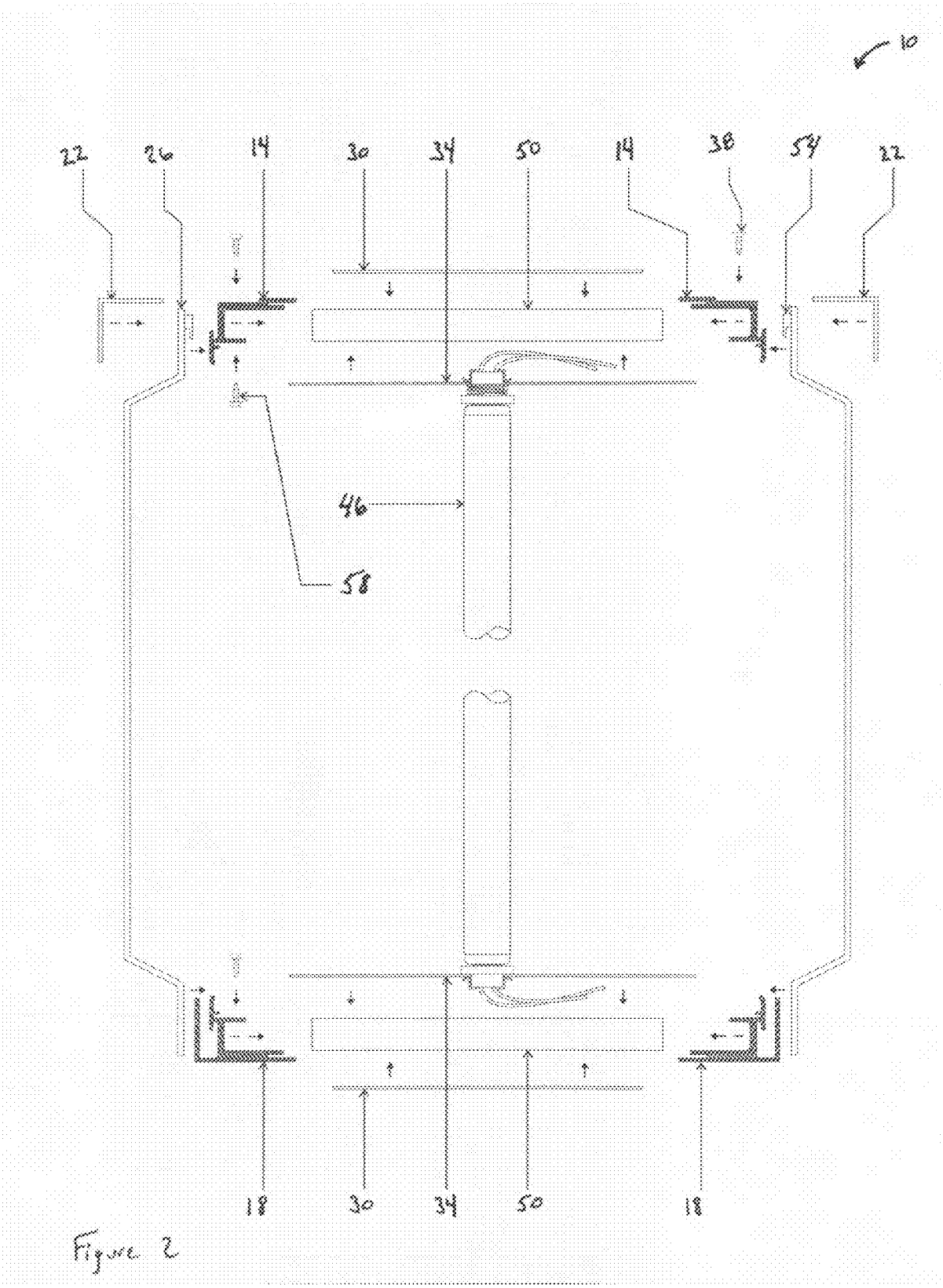
FIG. 2 is an exploded top view of one embodiment of the present invention.

Referring to the Figures, FIGS. 1-5 illustrate an improved cabinet-style advertising or display system referred to as signcase 10. In general, signcase 10 includes inventive brackets 14, inventive brackets with integral angle retainer 18, a plastic sign face 26, angle retainers 22, and a lighting arrangement. As illustrated in FIGS. 1-2, signcase 10 is in an assembled, rectangular housing configuration. However, the cabinet can be provided in a wide variety of configurations, shapes, number of signfaces, and sizes, which will become apparent to a person of ordinary skill in the art in view of the present disclosure.

In particular, FIGS. 1-2 illustrates a signcase 10 having inventive brackets 14 and inventive brackets with integral angle retainer 18. Brackets 14 and 18 are configured to slidably secure a signface 26 in place. In addition, brackets 14 and 18 slidably secure sign body sheets 30 and 34 in place. FIG. 1 illustrates one embodiment in which the brackets 14 and 18 are arranged width-wise. That is, inventive brackets 14 are shown at an upper portion of the signcase 10, and inventive brackets with integral angle retainer 18 are shown at a lower portion of the signcase 10. As will become apparent to one of ordinary skill in the art in view of the present disclosure, in alternative embodiments, brackets 14 and 18 can be reconfigured in a wide variety of arrangements. For example, inventive brackets with integral angle retainers 18 can be used as horizontal uppers and lowers, and inventive brackets 14 can be used as vertical supports.

Figure 3:
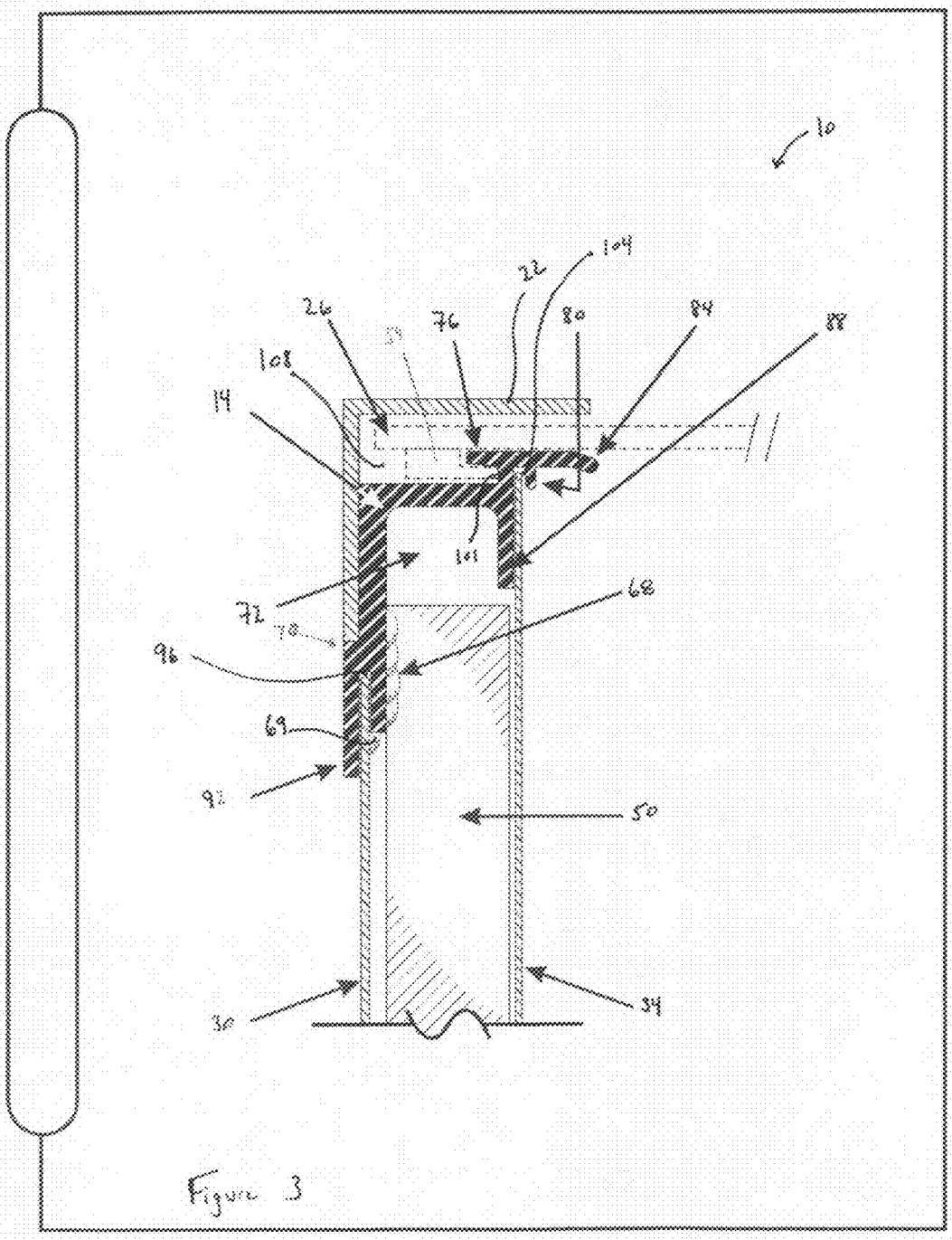
FIG. 3 is a cross-sectional side view of one embodiment of the present invention.
Figure 5:
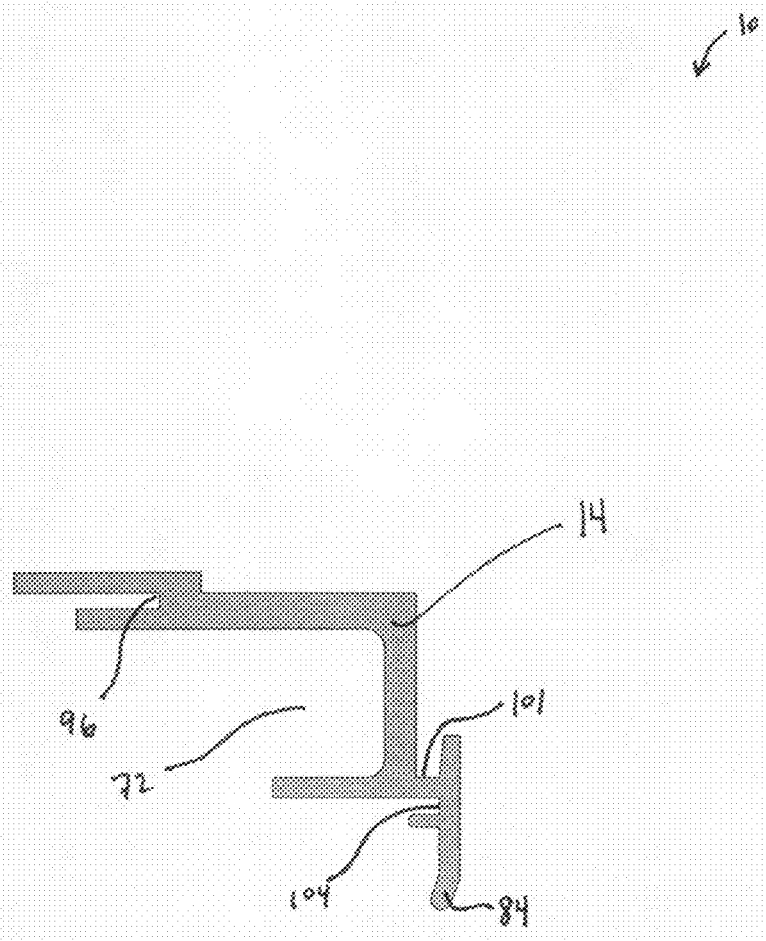
FIG. 5 is a cross-sectional side view of an open rail 14 according to one embodiment of the present invention.

FIG. 3 best illustrates inventive brackets 14 in an assembled configuration. Inventive bracket 14, also shown in FIG. 5, is preferably extruded from a rigid material such as metal. One exemplary metal is aluminum because of its low weight, strength, and resistance to corrosion. Multiple inventive brackets 14 can be butt welded and staggered to provide structural integrity and customizable lengths.

As shown, inventive bracket 14 includes notches 96, 101 and 104. Notch 96 is configured to receive sign body sheet 30, which serves as filler for the signcase. Once sign body 30 is inserted into notch 96, it can be welded at weld area 69. Alternatively, sign body 30 can be riveted in place. Other methods of securing sign body 30 will become apparent to a person of ordinary skill in the art in view of the present disclosure. As best shown in FIG. 3, a lip 92 is provided to avoid visible marring of the signface or sign body, particularly by welding at 68 or 69. A cross brace 50 is further provided to tie the entire frame together, provide structural support and integrity, and prevent sign body sheet 34 from cupping. Cross brace 50, in different embodiments a square tube or L shape, is welded to inventive bracket 14 at welding area 68.

Notch 101 on interlocking sign hanger forms a track for receiving signface 26. More specifically, notch 101 prevents the hang bar track 54 of signface 26 from slipping out of retainer area 108. Angle retainer 22 likewise prevents hang bar track 54 from dislodging out of retainer area 108. That is, angle retainer 22 interlocks-in hang bar track 54. As best shown in FIG. 1, angle 22 can be secured to bracket 14 by screws 38, such as counter sunk sheet metal screws, for example. Conversely, hang bar track 54 can be removed by removing angle retainer 22. Once angle retainer 22 is removed, the hang bar track 54 can be unhooked. Otherwise, the signface must be slid out of notch 101.

Notch 104 is configured to receive sign body sheet 34. Notch 104 thus holds the metal lamp socket panel (sign body sheet 34) in place. Bracket 14 further includes a beveled edge 84, which facilitates insertion of signface 26 into retainer area 108, and more specifically, notch 101 more easily.

Figure 4:
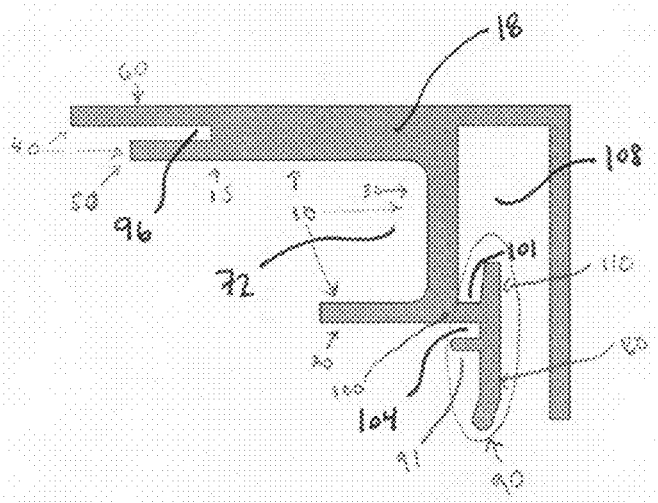
FIG. 4 is a cross-sectional side view of a closed rail 18 according to one embodiment of the present invention.

Referring to FIGS. 1, 2, and 4, bracket with integral retainer 18 is illustrated. Bracket 18, includes a retainer area 108, notches 96, 101, and 104, and generally has similar features to bracket 14. However, instead of using a separate angle retainer 22 to lock-in signface 26, bracket 18 is configured to slidably receive and secure a signface 26. Multiple brackets 18 can be butt welded and staggered to provide structural integrity and customizable lengths.

As illustrated in FIGS. 1 and 2, signcase 10 can be (optionally) provided with a lighting fixture to provide sign illumination. Exemplary lights include metal halide lights or high output fluorescent lamps. As shown in FIG. 1, fluorescent lamps can be easily installed in snap-in fluorescent lamp sockets 42. Brackets 14 and 18 include raceways 72, which are configured to receive energy supply wiring for lighting assemblies.

Figure 6:
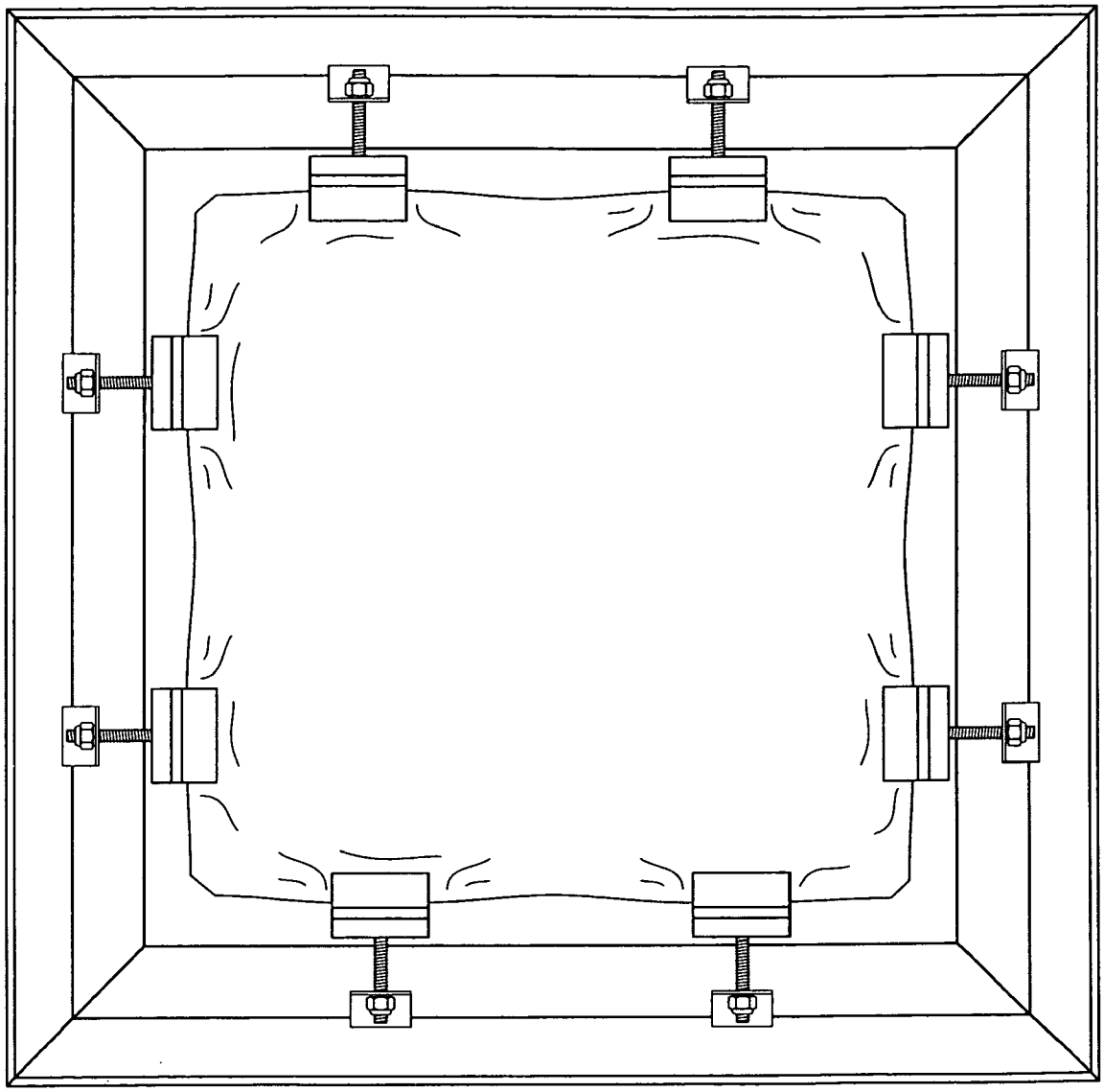
FIG. 6 is a depiction of a Flex-Face suspended sign constructed from the inventive bracket.

FIG. 6 depicts the use of the inventive bracket in the flex-face sign embodiment of the present invention. Suspenders 1 are hooked onto the interlocking sign hanger. A angle retainer (not shown) can be included, integral or not.

It is therefore intended that the foregoing detailed description be regarded as illustrative rather than limiting, and that it be understood that it is the following claims, including all equivalents, that are intended to define the spirit and scope of this invention.

The invention claimed is:

1. An assembly comprising:

a first structural bracket having a profile comprising:

a first sign body groove;

a first C-bracket;

an interlocking sign hanger; and a first cross brace wherein the first C-bracket comprises three sides including a central side and two terminal sides;

wherein the two terminal sides are parallel, of unequal length, and perpendicular to the central side; wherein the longer terminal side of the C bracket bears the first sign body groove, and wherein the cross brace is dimensioned such that upon assembly with the first structural bracket, the first cross brace is in continuous contact with the longer side of the first C-bracket, and in at least point contact with the shorter side of the first C-bracket, and wherein the interlocking hanger is attached to the central side of the first C-bracket.

2. An assembly as in claim 1, wherein the at least point contact comprises contact between the end of the first C-bracket and the end of the first cross brace.

3. An assembly as in claim 1, wherein the at least point contact comprises contact between the side of the side of the first C-bracket and the side of the first cross brace, and wherein the contact is fixed by welding.

4. An assembly as in claim 1, wherein the first cross brace is characterized by an L-shaped profile.

5. An assembly as in claim 1, wherein the first cross brace is characterized by a closed-shape profile.

6. An assembly as in claim 1, wherein the first cross brace is characterized by a square or rectangular profile.

7. An assembly as in claim 1, wherein the first structural bracket is formed by extrusion.

8. An assembly as in claim 1, wherein the assembly further comprises a sign comprising an interlocking hanger capable of interlocking with the interlocking sign hanger.

9. An assembly as in claim 1, wherein the assembly further comprises a sign body which is capable of fitting into the first sign body groove.

10. An assembly as in claim 9 wherein the sign body is inserted into the first sign body groove and spot welded from the underside of the first sign body groove.

11. An assembly as in claim 10 wherein the assembly further comprises a first angle retainer.

12. An assembly as in claim 11 wherein the structural bracket further comprises a first angle retainer integral with the first C-bracket.

13. An assembly as in claim 12 wherein the assembly further comprises second structural bracket comprising;

a structural bracket having a profile comprising:

a second sign body groove;

a second C-bracket; and a second angle retainer; and a second cross brace;

wherein the second C-bracket comprises three sides including a central side and two terminal sides; wherein the two terminal sides are parallel, of unequal length, and perpendicular to the central side; wherein the longer terminal side of the second C bracket bears the second sign body groove, and wherein the second cross brace is dimensioned such that upon assembly with the second structural bracket, the cross brace is in continuous contact with the longer side of the second C-bracket, and in at least point contact with the shorter side of the second C-bracket, and wherein the interlocking hanger of the sign is interlocked with the interlocking hanger attached to the first C-bracket.

14. An assembly as in claim 13 wherein the interlocking hanger of the sign is interlocked with the interlocking sign hanger and wherein the back of the sign contacts the second angle retainer.

15. An assembly as in claim 14 wherein the second angle retainer is integral with the second structural bracket.

16. An assembly as in claim 15 wherein the second angle retainer and integral second structural bracket are extruded as one piece.

17. An assembly as in claims 1 or 14 wherein the sign and the hanger are interlocked such that there is essentially no space between the central side of the first C-bracket and the interlocking hanger of the sign.

* * * * *